US006498915B2

(12) United States Patent
Yamaguchi et al.

(10) Patent No.: US 6,498,915 B2
(45) Date of Patent: Dec. 24, 2002

(54) COLOR IMAGE FORMING APPARATUS WITH SEPARATE HOUSINGS FOR IMAGE FORMING UNITS

(75) Inventors: Naoki Yamaguchi, Kasuga (JP); Masakazu Aoki, Fukuoka (JP); Yuzo Kawano, Ogori (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/822,497

(22) Filed: Apr. 2, 2001

(65) Prior Publication Data

US 2001/0028810 A1 Oct. 11, 2001

(30) Foreign Application Priority Data

Apr. 7, 2000 (JP) ..... 2000-106032

(51) Int. Cl.[7] ..... G03G 15/00
(52) U.S. Cl. ..... 399/110
(58) Field of Search ..... 399/110, 111, 399/112

(56) References Cited

U.S. PATENT DOCUMENTS 5,014,094 A * 5/1991 Amitani et al. ..... 399/112 X
5,282,012 A * 1/1994 Terada et al. ..... 399/112
5,953,559 A * 9/1999 Obu ..... 399/110

FOREIGN PATENT DOCUMENTS

JP 2000284592 10/2000

* cited by examiner

*Primary Examiner*—Fred L Braun
(74) *Attorney, Agent, or Firm*—Stevens, Davis, Miller & Mosher, LLP

(57) ABSTRACT

A tandem type color image forming apparatus has a plurality of image forming units. These units includes at least a plurality of spaced photosensitive drums, and a plurality of developing rollers for developing with toners electrostatic latent images formed on these photosensitive drums. The image forming units except the image forming unit for black color that may be highly frequently used are accommodated in the same first housing. The unit for black color is accommodated in another second housing. The first and second housings are made to be attachable to and detachable from the chassis of the apparatus main body independently of each other. Only an image forming unit with high frequency of inspection or maintenance can separately be detached, so that the work load for inspection or maintenance is reduced, and handling of the apparatus is easy.

8 Claims, 6 Drawing Sheets

COLOR IMAGE FORMING APPARATUS WITH SEPARATE HOUSINGS FOR IMAGE FORMING UNITS

BACKGROUND OF THE INVENTION

The present invention relates to a color image forming apparatus for forming a composite image by superposing image information using electrophotographic technology or the like.

Conventionally, in an image forming apparatus using electrophotographic technology, an image is formed in the manner that an electrophotographic photosensitive body, serving as an image carrier, is charged with an electrifier, this photosensitive body is irradiated with light in accordance with image information to form a latent image, this latent image is developed with a developing device to be visible, and a toner image thus obtained is transferred onto a sheet material or the like.

On the other hand, with the coloring of image, many tandem type image forming apparatus have been proposed until now, in which a plurality of image carriers to each of which such a series of image forming processes is performed are provided, and a full color image is formed in the manner that a cyan image, a magenta image, a yellow image, and preferably a black image are formed on the respective image carriers, and those images are superposed and transferred onto a sheet material at the transfer positions of the respective image carriers. Such a tandem type color image forming apparatus is advantageous for high speed image formation because it has an image forming section for each color.

Such a tandem type color image forming apparatus, as described in, for instance, Japanese Patent Application Ser. No. 11-92598 (Laid-Open Publication No. 2000-284592) of the same assignee, comprises image forming units for forming toner images of the respective colors, i.e., yellow (Y), magenta (M), cyan (C), and black (K), an exposure unit for outputting an image signal to form an electrostatic latent image, an intermediate transfer belt formed into a closed loop and running, and a fixing unit, wherein toner images on the intermediate transfer belt are transferred onto a paper P fed from a paper cassette, and the toner images are fixed to the paper with the fixing unit.

The image forming units for yellow (Y), magenta (M), cyan (C), and black (K) have the same structure, and each unit is the combination of a photosensitive unit including a photosensitive drum on the circumferential surface of which an electrostatic latent image is formed with a laser beam from the exposure unit, an electrifying brush for charging the photosensitive drum with electricity, and a cleaning blade, and a developing unit including a toner supplying tank, a toner supplying roller, and a developing roller brought into contact with the photosensitive drum.

In the conventional tandem type color image forming apparatus, all the image forming units for yellow (Y) color, magenta (M) color, cyan (C) color, and black (K) color are incorporated together in one housing. Therefore, when inspection or maintenance of each image forming unit, the housing is drawn out from the chassis of the image forming apparatus and all the four image forming units are taken out.

On the other hand, a color image forming apparatus is used not only for color image formation using the toners of all colors but also for monochrome image formation using only black color. The frequency of this monochrome image formation using only black is relatively high. Therefore, the frequency of toner supply or inspection/maintenance of the image forming unit for black (K) color is apt to be higher as compared with any other image forming unit.

In the conventional tandem type color image forming apparatus, however, all the four image forming units are incorporated in one housing. Therefore, even when inspection or maintenance of the image forming unit of black (K) color only is to be performed, it is taken out and put in the chassis together with the other three image forming units. Consequently, the image forming units having no need of inspection or maintenance also must be treated, and the user's handling efficiency is not always good. Besides, since the other image forming units must be taken out and put in every time when frequent inspection or maintenance of the image forming unit of black (K) color is performed, the work load becomes heavy.

BRIEF SUMMARY OF THE INVENTION

It is an object of the present invention to provide color image forming apparatus in which only an image forming unit with high frequency of inspection, maintenance, or the like, can separately be treated, thereby reducing the work load upon inspection/maintenance and making the handling easy.

According to the invention, a color image forming apparatus comprises a chassis for attachment in an apparatus main body, a plurality of image forming units including at least a plurality of photosensitive drums disposed at intervals, and a plurality of developing rollers for developing with toners electrostatic latent images formed on the respective photosensitive drums, and a plurality of housings each provided with open upper ends for respectively accommodating the image forming units while dividing them into a plurality of groups, the housings being independently attachable to and detachable from the chassis, respectively.

According to the structure of the above-described color image forming apparatus, an image forming unit requiring inspection or maintenance is detached from the apparatus by taking out the corresponding housing from the chassis, and a necessary work can be done.

The image forming units are, e.g., four for yellow, magenta, cyan, and black. In this case, it is preferable that the image forming units for yellow, magenta, and cyan are accommodated in first one of the housings, and the image forming unit for black is accommodated in the second housing. With this configuration, since only the image forming unit of black that may be highly frequently used can be taken out from the apparatus, the handling efficiency is improved.

Adjacent ones of the plurality of housings are preferably provided on their opposite surfaces with concavo-convex engagement portions for guiding those housings in the directions of chassis attachment and detachment and for performing vertical positioning. Each housing can easily be performed detachment from and attachment to the chassis and vertical positioning through engagement between the engagement portion of the housing and that an adjacent housing in the chassis.

Each image forming unit may have a casing formed to be inserted in the corresponding housing from above, which has a portion in a shape covering the periphery of the electrifying brush of an adjacent image forming unit. With the provision of such a casing, toner adhering to the electrifying brush of the adjacent image forming unit can be prevented from scattering.

DETAILED DESCRIPTION OF THE INVENTION

An embodiment of the present invention will be now described with reference to the accompanying drawings.

Figure 1:
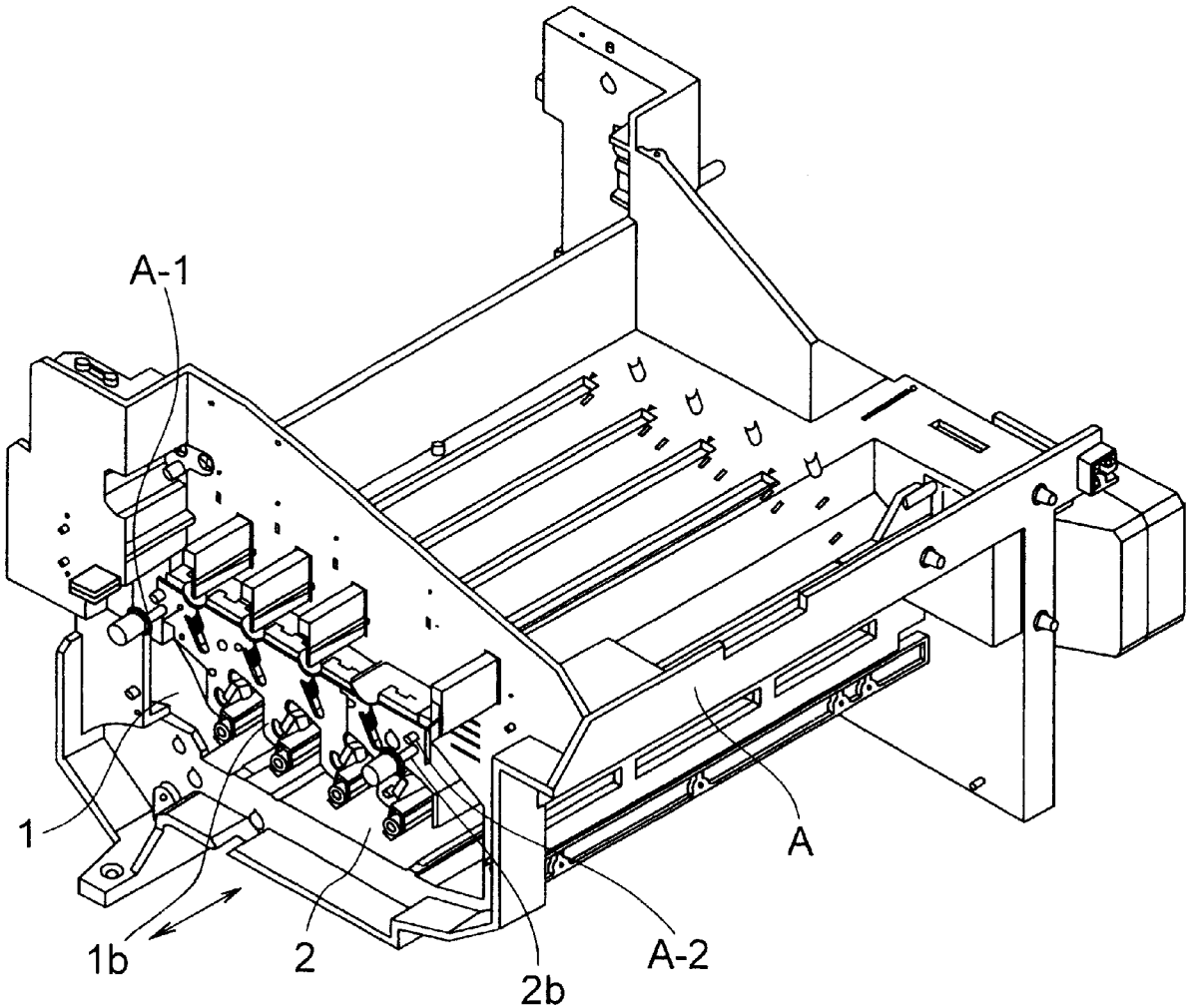
FIG. 1 is a perspective view showing the construction of an essential part of a color image forming apparatus according to an embodiment of the present invention.

FIG. 1 is a perspective view showing the construction of an essential part of a color image forming apparatus according to the embodiment of the invention.

Referring to FIG. 1, first and second housings 1 and 2 are attached to a chassis A fixed in a main body (not shown) of the color image forming apparatus. Each of the first and second housings 1 and 2 can freely be taken out and put in the chassis A in the directions of arrows in the figure. The taking-out/putting-in directions are the same as the directions in which the first and second housings 1 and 2 are taken out and put in relative to the main body of the color image forming apparatus.

Figure 2:
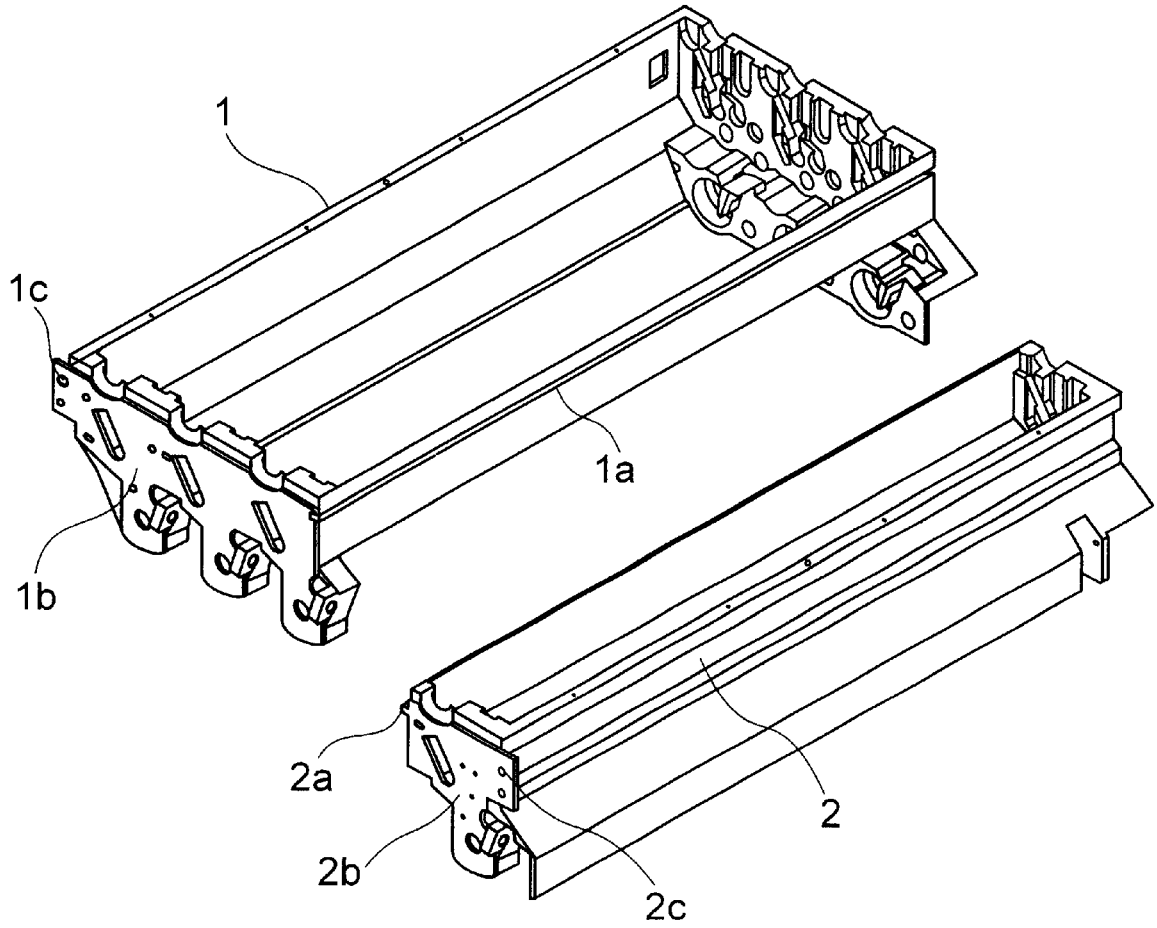
FIG. 2 is an exploded perspective view of first and second housings.
Figure 3:
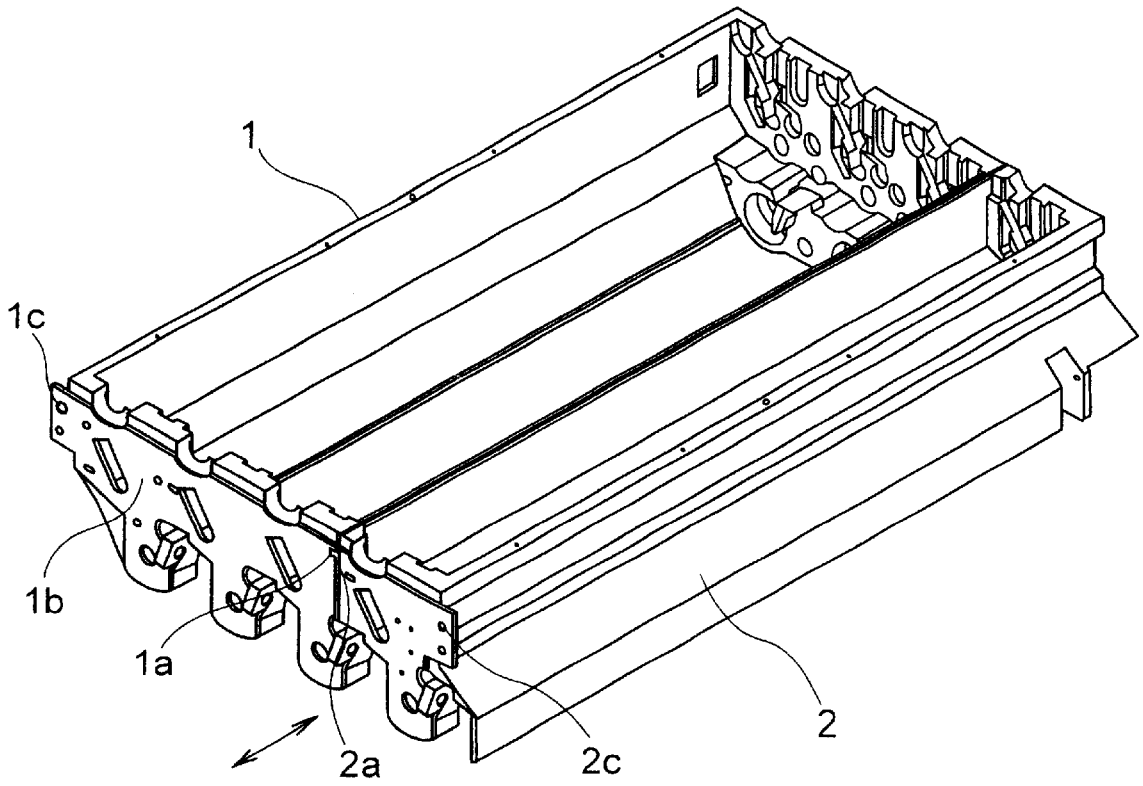
FIG. 3 is a perspective view of the first and second housings assembled.

FIG. 2 is an exploded perspective view of the first and second housings. FIG. 3 is a perspective view of the first and second housings assembled.

Either of the first and second housings 1 and 2 is formed in a vessel shape whose upper part is open, for accommodating image forming units each including a photosensitive drum, a developing roller, and so on, which will be described later. The first housing 1 accommodates image forming units for yellow (Y) color, magenta (M) color, and cyan (C) color, while the second housing 2 accommodates an image forming unit for black (K) color. The sides of the first and second housings 1 and 2 facing each other are provided with an engagement groove 1*a* and a ridge 2*a,* respectively. The engagement groove 1*a* is rectangular in its cross section and extends through the whole length of the first housing 1. The ridge 2*a* has its cross section that can fit in the engagement groove 1*a* and slide therein. The ridge 2*a* extends through the whole length of the second housing 2. Provision of the engagement groove 1*a* and the ridge 2*a* make it possible to move the second housing 2 in the directions of arrows in FIG. 3 in a state that the ridge 2*a* is inserted in the engagement groove 1*a,* while the first housing 1 is kept fixed. Reinforcement metal sheets 1*b* and 2*b* are firmly joined with the end surfaces on the drawn-out side of the first and second housings 1 and 2, respectively. These reinforcement metal sheets 1*b* and 2*b* are respectively provided with positioning holes 1*c* and 2*c* for positioning the housings relatively to the chassis A. Either of the positioning holes 1*c* and 2*c* is a circular opening. Positioning pins A-1 and A-2 provided at two positions on an end surface of the chassis A are fitted in the respective positioning holes 1*c* and 2*c* to position the first and second housings 1 and 2 relatively to the chassis A at once.

Figure 4:
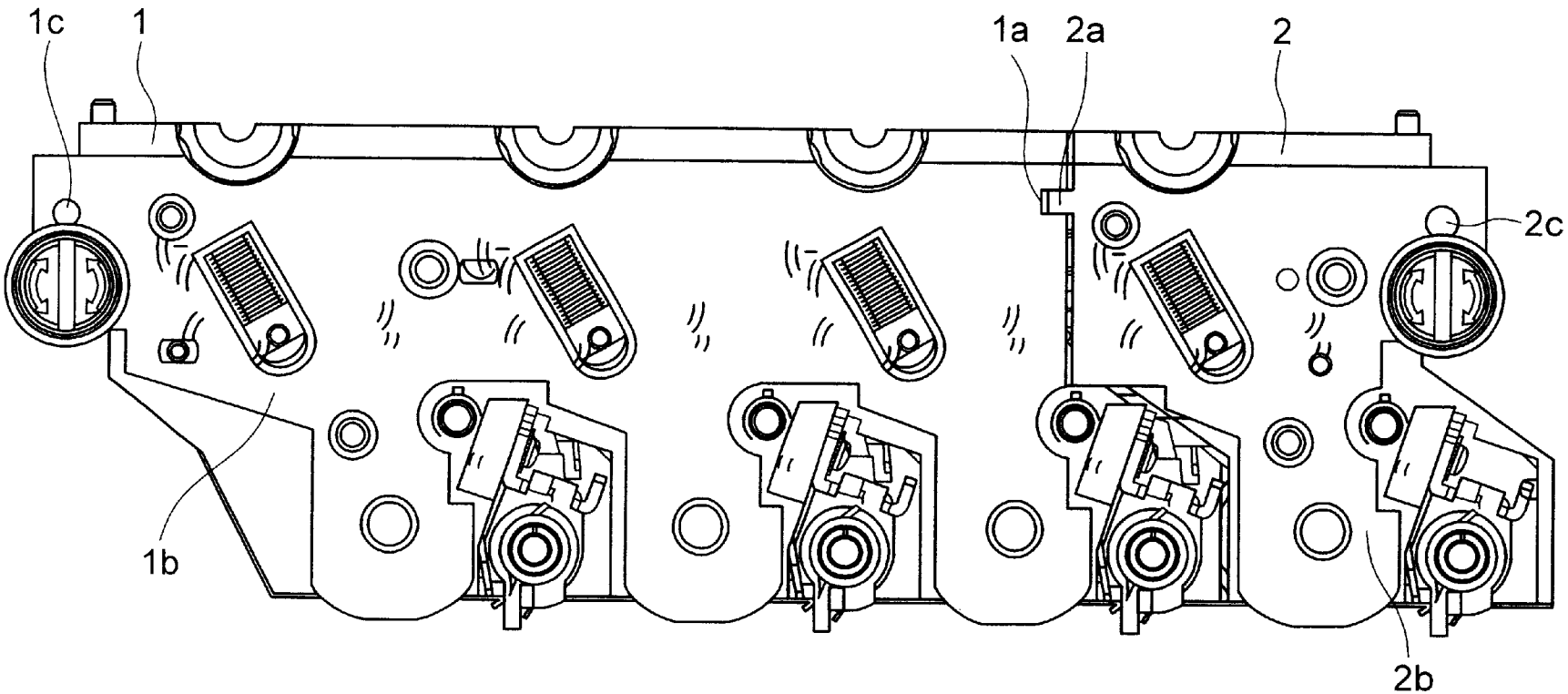
FIG. 4 is a front view of the first and second housings in which image forming units have been incorporated.
Figure 5:
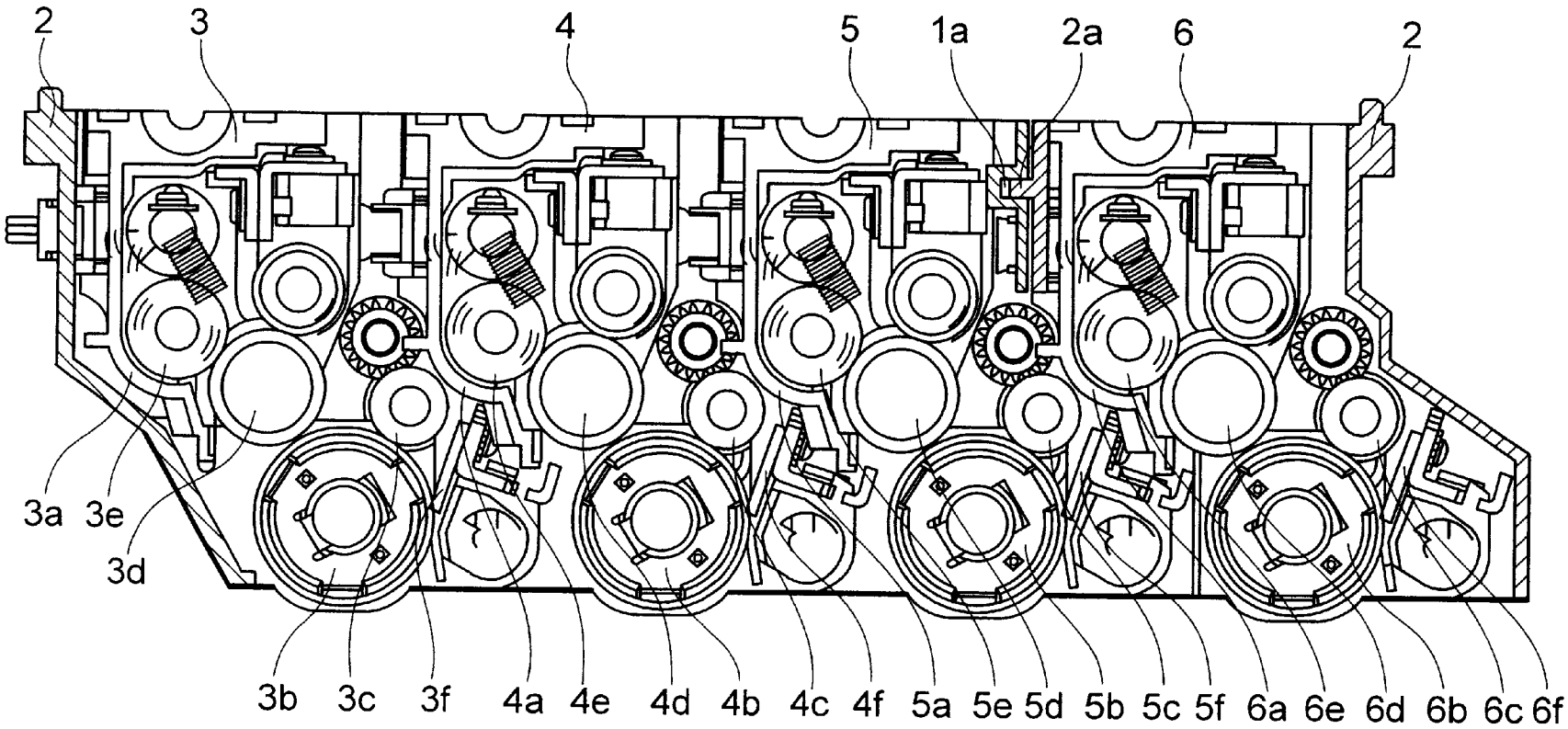
FIG. 5 is a vertical sectional view showing an essential part in the state that the image forming units are incorporated in the first and second housings.

FIG. 4 is a front view of the first and second housings in which image forming units are incorporated. FIG. 5 is a vertical sectional view showing an essential part of the first and second housings in the state that the image forming units are incorporated.

As shown in FIG. 5, the image forming units 3, 4, and 5 for yellow (Y) color, magenta (M) color, and cyan (C) color are incorporated in this order from the left in the first housing 1, and the image forming unit 6 for black (K) color is incorporated in the second housing 2.

The image forming units 3 to 6 have the same structure. They each have casings 3*a,* 4*a,* 5*a,* and 6*a* as support frames; photosensitive units comprising photosensitive drums 3*b,* 4*b,* 5*b,* and 6*b* and electrifying brushes 3*c,* 4*c,* 5*c,* and 6*c;* developing units comprising developing rollers 3*d,* 4*d,* 5*d,* and 6*d* brought into contact with the respective photosensitive drums 3*b* to 6*b,* supply rollers 3*e,* 4*e,* 5*e,* and 6*e* for supplying toner to the respective developing rollers 3*d* to 6*d* from toner tanks (not shown), etc.; and cleaning blades 3*f,* 4*f,* 5*f,* and 6*f* for removing adhering toner from the respective photosensitive drums 3*b* to 6*b.* The photosensitive drums 3*b* to 6*b* each are driven to be rotated counterclockwise. The circumferential surfaces of the respective photosensitive drums 3*b* to 6*b* are electrically charged with electrifying brushes 3*c* to 6*c,* and latent images are formed on the respective circumferential surfaces with laser beams from an exposure unit (not shown). The latent images are developed with the respective developing rollers 3*d* to 6*d* that have been supplied onto their circumferential surfaces with toner of the respective colors. Like the image forming apparatus of the prior application referred to hereinbefore, the photosensitive drums 3*b* to 6*b* are brought into contact with an intermediate transfer belt (not shown) formed into a closed loop, and toner images developed with toners are transferred onto the intermediate transfer belt. The intermediate transfer belt transfers the toner images, which have been transferred onto the surface of the intermediate transfer belt, onto a paper (not shown). The paper onto which the toner images have been transferred is sent to a fixing unit (not shown) to fix the toner images.

In the above-described construction, both of the first housing 1 accommodating the image forming units 3 to 5 and the second housing 2 accommodating the image forming unit 6 of black (K) are incorporated in the chassis A as shown in FIG. 1. At this time, in the first and second housing 1 and 2, the photosensitive drums 3*b* to 6*b* are positioned in the directions of array pitch by the positioning holes 1*c* and 2*c* of the reinforcement metal sheets 1*b* and 2*b* and the positioning pins A-1 and A-2 of the chassis A By this positioning, even with the combination of the separate first and second housings 1 and 2, the four photosensitive drums 3*b* to 6*b* in series can be fixed at their designed array pitches. Therefore, color drift or shift upon formation of a multiplex image can be prevented. Besides, the first and second housing 1 and 2 mutually restrict their vertical positions through engagement between their engagement groove 1*a* and ridge 2*a.* Accordingly, only by vertically positioning the large-size first housing 1 relatively to the chassis A, the second housing 2 also can be similarly positioned relatively to the chassis A.

In this manner, even in case of using the separate first and second housings 1 and 2, when they are incorporated in the chassis A, the photosensitive drums 3*b* to 6*b* can be positioned in the directions of array pitch and height. Therefore, transfer of images from the photosensitive drums 3*b* to 6*b* onto the intermediate transfer belt can properly be performed.

Figure 6:
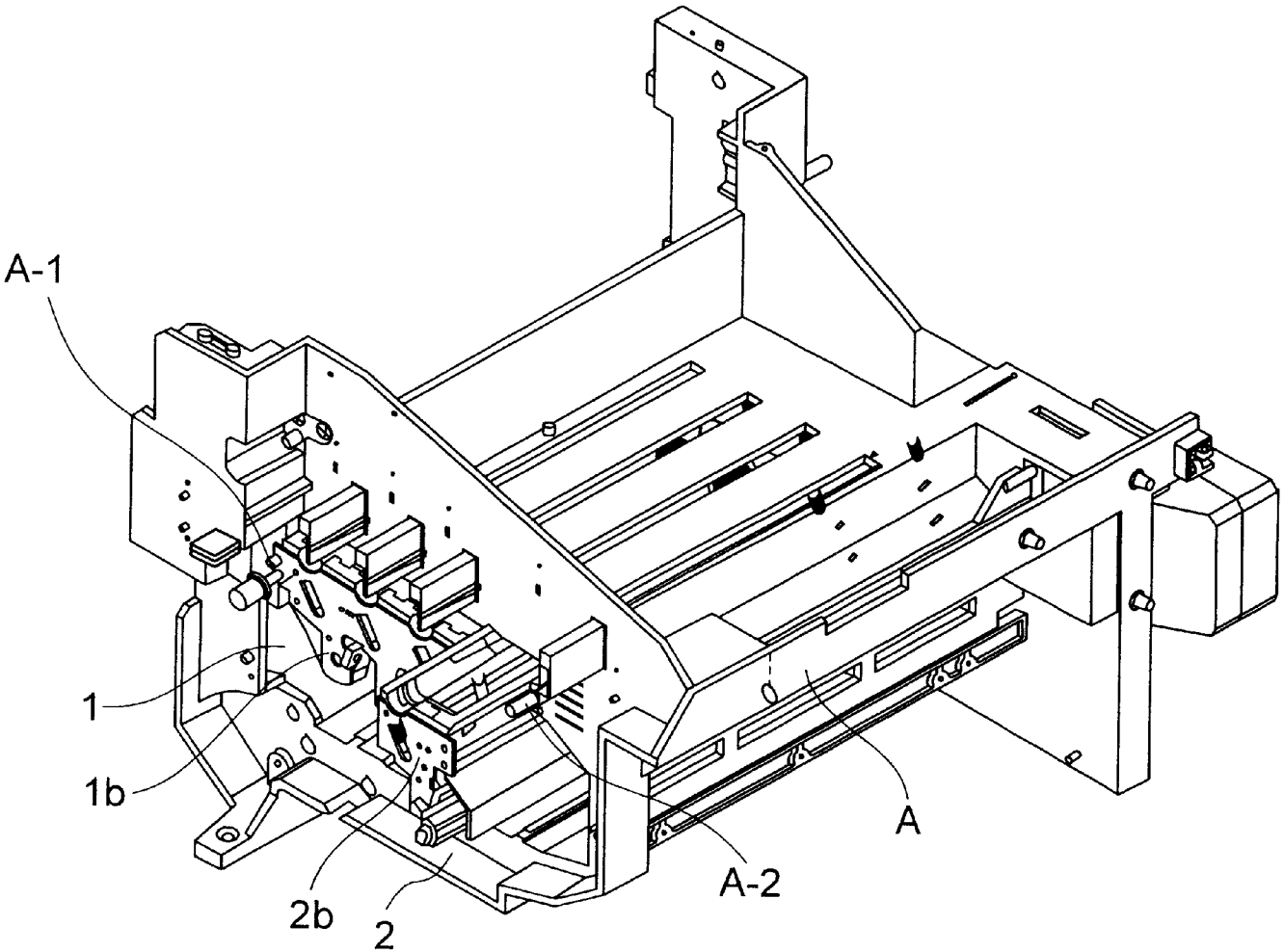
FIG. 6 is a perspective view showing a state that only the second housing is drawn out from a chassis of the apparatus.

When an inspection or maintenance operation is performed for the image forming unit 6 in the second housing 2 that may be highly frequently used, as shown in the perspective view of FIG. 6 in the state that only the second housing has been drawn out, it is sufficient to draw out only the second housing 2 from the chassis A. That is, if the first housing 1 is fixed to the chassis A with a damper or the like detachably attached, the ridge 2*a* of the second housing 2 can slide in the engagement groove 1*a* of the first housing 1 as a guide, and the second housing 2 can be drawn out. Thus only the image forming unit 6 of black (K) color can be taken out from the main body of the apparatus without drawing out the first housing 1. Therefore, the inspection or maintenance operation can be performed while the image forming units 3 to 5 that have no need of inspection or maintenance are left in the chassis A. This makes handling easy. When the image forming units 3 to 5 also require inspection or maintenance, the first housing can also be taken out.

When the first and second housings 1 and 2 are incorporated in the chassis A, the casing 6*a* of the image forming unit 6 incorporated in the second housing 2 covers the electrifying brush 5*c* of the image forming unit 5 in the first housing 1. Residual toner remaining on the circumferential surface of the photosensitive drum 5*b* tends to adhere to the electrifying brush 5*c,* but the casing 6*a* covering the electrifying brush 5*c* can prevent the adhering toner from scattering. Thus, since the casing 6*a* can serve as a cover for the electrifying brush 5*c* of the left neighboring image forming unit 5, the electrifying brush 5*c* has no need of its exclusive cover. Therefore, the occupied space around the electrifying brush 5*c* can be narrowed. The same applies also to the image forming units 3 and 4.

According to the invention, for example, when the configuration is such that only the image forming unit of black color that may be highly frequently used is incorporated in one housing, and the other image forming units of yellow, magenta, and cyan are together incorporated in another housing, only the image forming unit of black with high frequency of inspection or maintenance can be taken out from the chassis, and the handling efficiency can be improved. Besides, when concavo-convex engagement portions are provided on the opposite surfaces of adjacent ones of the plurality of housings, guide function and vertical positioning between the housings can be done. This makes handling easier.

What is claimed is:

1. A color image forming apparatus, comprising:

a chassis for attachment in an apparatus main body;

a plurality of image forming units including at least a plurality of photosensitive drums disposed at intervals, and a plurality of developing rollers that develop with toners electrostatic latent images formed on the respective photosensitive drums; and a plurality of housings provided with open upper ends that respectively accommodate said image forming units while dividing them into a plurality of groups, said housings being separately attachable to and detachable from said chassis, respectively.

2. The apparatus according to claim 1, wherein said image forming units are four for yellow color, magenta color, cyan color, and black color, the image forming units for yellow, magenta, and cyan are accommodated in a first one of said housings, and the image forming unit for black is accommodated in a second one of said housings.

3. The apparatus according to claim 1, wherein adjacent housings of said plurality of housings are provided on their opposite surfaces with concavo-convex engagement portions for guiding those housings in directions of chassis attachment and detachment and for performing vertical positioning.

4. The apparatus according to claim 2, wherein said first and second housings are attached to said chassis while being adjacent to each other, and provided on their opposite surfaces with concavo-convex engagement portions for guiding these housings in directions of chassis attachment and detachment and for performing vertical positioning.

5. The apparatus according to claim 1, wherein each image forming unit comprises a casing, and an electrifying brush disposed in the vicinity of a photosensitive drum of this image forming unit and electrically charges said photosensitive drum, said casing is formed to be inserted in the corresponding housing from above, and said casing has a portion in a shape covering a periphery of the electrifying brush of an adjacent image forming unit.

6. The apparatus according to claim 2, wherein each image forming unit comprises a casing, and an electrifying brush that is disposed in the vicinity of a photosensitive drum of this image forming unit and that electrically charges said photosensitive drum, said casing is formed to be inserted in the corresponding housing from above, and said casing has a portion in a shape covering a periphery of the electrifying brush of an adjacent image forming unit.

7. The apparatus according to claim 3, wherein each image forming unit comprises a casing, and an electrifying brush that is disposed in the vicinity of a photosensitive drum of this image forming unit and that electrically charges said photosensitive drum, said casing is formed to be inserted in the corresponding housing from above, and said casing has a portion in a shape covering a periphery of the electrifying brush of an adjacent image forming unit.

8. The apparatus according to claim 4, wherein each image forming unit comprises a casing, and an electrifying brush that is disposed in the vicinity of a photosensitive drum of this image forming unit and that electrically charges said photosensitive drum, said casing is formed to be inserted in the corresponding housing from above, and said casing has a portion in a shape covering a periphery of the electrifying brush of an adjacent image forming unit.

* * * * *